US006267157B1

(12) United States Patent
Gruson et al.

(10) Patent No.: US 6,267,157 B1
(45) Date of Patent: Jul. 31, 2001

(54) DEVICE FOR FILLING RECEPTACLES AND FITTED WITH AN INTEGRATED CLEANING DEVICE

(75) Inventors: Bertrand Gruson, Breville/Mer; Samuel Bigo, La Ferte Bernard, both of (FR)

(73) Assignee: Serac Griyo, La Ferte Bernard (FR)

( * ) Notice: Subject to any disclaimer, the term of this patent is extended or adjusted under 35 U.S.C. 154(b) by 0 days.

(21) Appl. No.: 09/531,226

(22) Filed: Mar. 20, 2000

(30) Foreign Application Priority Data

Mar. 26, 1999 (FR) ..... 99 03815

(51) Int. Cl.[7] ..... B67C 3/00
(52) U.S. Cl. ..... 141/90; 141/91; 222/148
(58) Field of Search ..... 141/89–91; 222/148, 222/149; 134/166 R, 170

(56) References Cited

U.S. PATENT DOCUMENTS 4,527,377 * 7/1985 Hayashi et al. ..... 141/90
4,534,494 * 8/1985 Hautemont ..... 222/148
4,572,252 * 2/1986 Ponzi et al. ..... 141/90
4,964,444 * 10/1990 Hanerus et al. ..... 141/90
5,531,253 * 7/1996 Nishiyama et al. ..... 141/90
5,562,129 10/1996 Graffin ..... 141/90
5,862,840 1/1999 Hansen ..... 141/90
5,865,221 * 2/1999 Ludwig et al. ..... 141/89
6,065,510 * 5/2000 Andersson et al. ..... 141/90
6,070,622 * 6/2000 Rutter ..... 141/90

FOREIGN PATENT DOCUMENTS 2678920 1/1993 (FR) .

* cited by examiner

*Primary Examiner*—J. Casimer Jacyna
(74) *Attorney, Agent, or Firm*—Birch, Stewart, Kolasch & Birch, LLP

(57) ABSTRACT

The filling device comprises a delivery duct having a flow orifice associated with a plug, and a cleaning device comprising a collector pan fixed in leakproof manner to the delivery duct in the vicinity of the flow orifice and having a through orifice vertically in register with the flow orifice and a shutter member fixed to an actuator member so that together they form a rigid assembly which is mounted to move with helical motion about an axis normal to a plane containing the through orifice, the shutter member being off said axis.

6 Claims, 3 Drawing Sheets

DEVICE FOR FILLING RECEPTACLES AND FITTED WITH AN INTEGRATED CLEANING DEVICE

The present invention relates to a deice for filling receptacles, which device includes an integrated cleaning device.

BACKGROUND OF THE INVENTION

A filling device, e.g. a carousel, is known, in particular from document FR-A-2 720 733, which device comprises a series of filling heads each fitted with an integrated cleaning device. The cleaning device has a collector pan fixed in leakproof manner to the delivery duct of each filling head in the vicinity of a flow orifice therefrom, the collector pan having a through orifice disposed vertically in register with the flow orifice. The cleaning device has a shutter member carrying a sealing gasket and connected to a member for actuation via a resilient toggle so as to be movable between a disengaged position allowing the filling device to operate normally, and a position in which the through orifice is shut so as to allow the delivery duct to be cleaned by a substance flowing from the delivery duct into the collector pan, and filling it. Such a device makes it possible to clean in effective manner both inside and outside portions of the delivery duct in the vicinity of the flow orifice.

However, to avoid the shutter member accidentally leaving its shut position, a hard point is provided in the toggle mechanism. Going through this hard point when the shutter member is brought into its shut position causes the sealing gasket of the shutter member to be flattened quite hard prior to the flattening force being released. It is therefore necessary for the sealing gasket to be capable of being flattened elastically sufficiently to ensure that it remains compressed after it has passed through the hard point so as to be able to maintain sealing. Unfortunately, the materials constituting the sealing gasket and which are suitable for withstanding cleaning substances are generally relatively hard. There is therefore a risk that after passing through the hard point the sealing gasket will no longer be compressed sufficiently, thereby allowing the cleaning substance to leak.

Furthermore, the assembly constituted by the shutter member and the toggle mechanism is complex and bulky. When the device is to perform sterile filling, the assembly runs the risk, because of its bulk, of disturbing the flow of sterile gas that flows around the filling device.

OBJECTS AND SUMMARY OF THE INVENTION

The invention provides a filling device of the type described in the above-specified document, in which the actuator member and the associated shutter member are fixed to each other to form a rigid assembly mounted to move with helical motion about an axis normal to a plane containing the through orifice, the shutter member being located off said axis.

This provides a structure which is compact and the helical motion of the rigid assembly makes it possible to bring the shutter member progressively up to the through orifice of the collector pan and to apply the shutter member firmly against the collector pan, thereby ensuring good sealing when shut. In addition, the axial component of the helical motion coincides with the direction in which force needs to be pressed against the shutter member, thereby reinforcing the effectiveness with which it shuts.

Advantageously, the shutter member is disposed inside the collector pan. The pressure of the cleaning substance flowing via the delivery duct thus contributes to pressing the shutter member against the collector pan, thereby reinforcing the effectiveness with which the through orifice is shut in leakproof manner.

BRIEF DESCRIPTION OF THE DRAWINGS

Other characteristics and advantages of the invention will appear on reading the following description of a particular, non-limiting embodiment of the invention.

Reference is made to the accompanying drawings, in which.

MORE DETAILED DESCRIPTION

With reference to the figures, the filling device of the invention comprises a series of filling heads, and only the inside portion of one of them is shown in the figures.

In conventional manner, the bottom portion of each filling head comprises a delivery duct 1 whose bottom end includes a flow orifice 2 associated with a plug 3.

Figure 1:
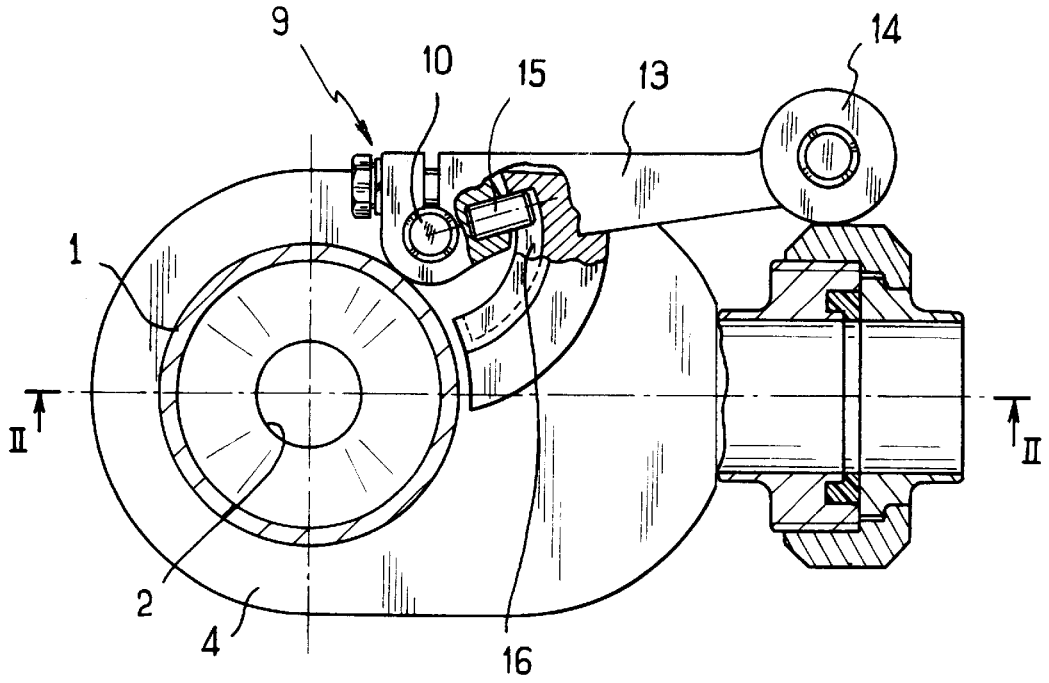
FIG. 1 is a partially-cutaway, fragmentary plan view of a filling device of the invention, its shutter member being in its disengaged position.
Figure 2:
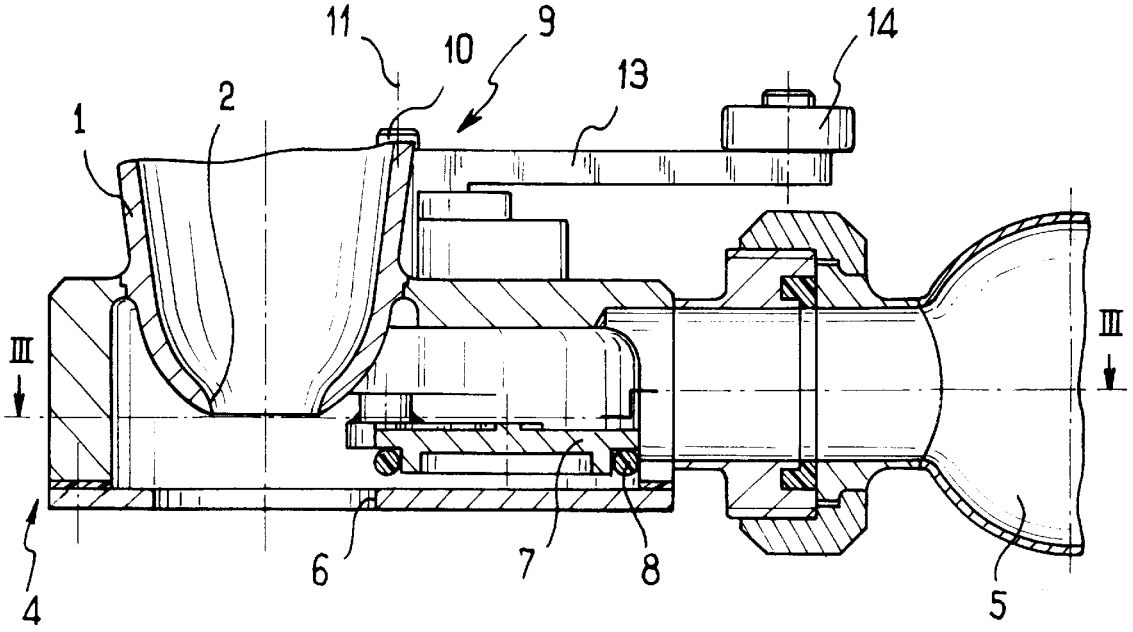
FIG. 2 is a section view on line II—II of FIG. 1.
Figure 3:
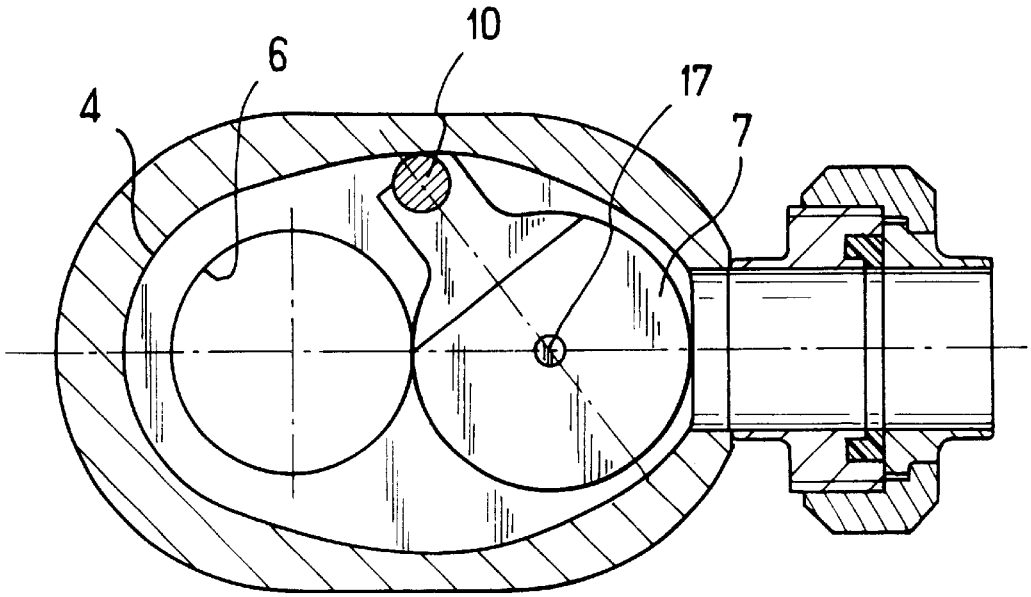
FIG. 3 is a section view on line III—III of FIG. 2.
Figure 4:
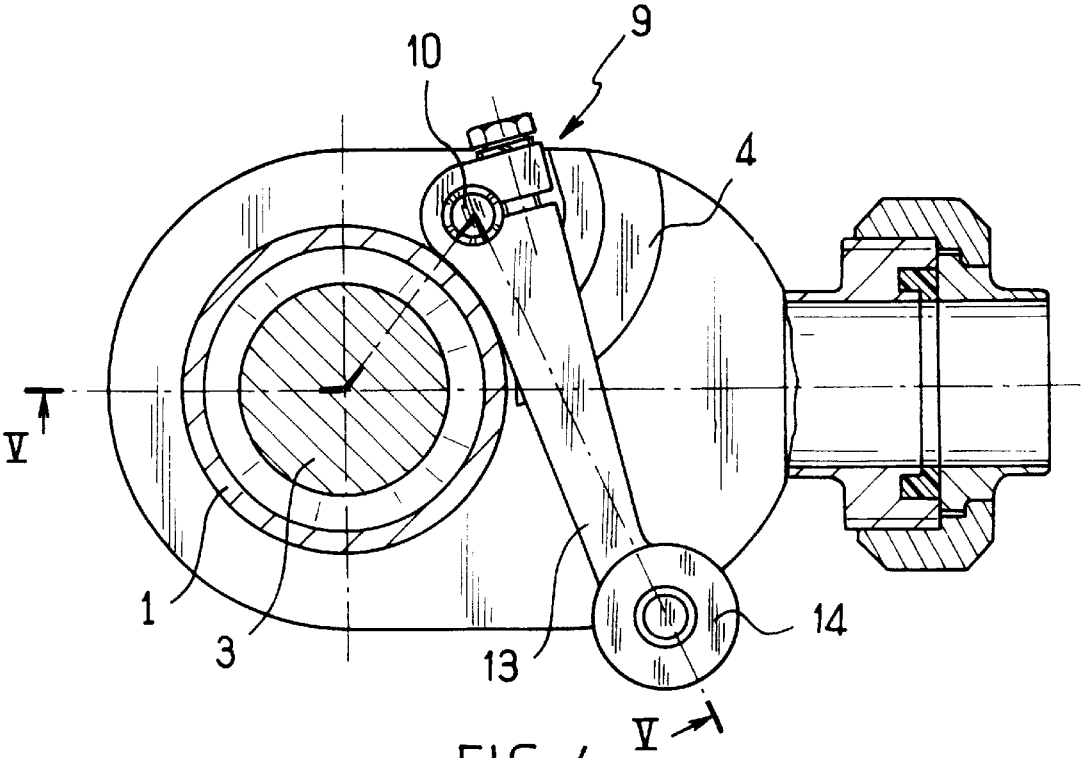
FIG. 4 is a partially-cutaway, fragmentary plan view of the filling device of the invention with its shutter member in the shut position.

Each filling head is associated with an integrated cleaning device comprising a collector pan 4 fixed in sealed manner to the delivery duct 1 in the vicinity of the flow orifice, e.g. by welding. The collector pan 4 is connected to a general collector manifold 5 common to all of the filling heads. The bottom portion of the delivery duct 1 is engaged inside the collector pan 4 which has a through orifice 6 disposed vertically in register with the flow orifice 2. A shutter member 7 provided with a sealing O-ring 8 is associated with the through orifice 6 and is movable between a position in which it shuts the through orifice 6, with the sealing O-ring being pressed against the collector pan 4 around the through orifice 6 (as shown in FIGS. 4 to 6), and a position in which said orifice is disengaged (as shown in FIGS. 1 to 3).

In accordance with the invention, the shutter member 7 is fixed to an actuator member given overall reference 9 so that together they form a rigid assembly.

Figure 5:
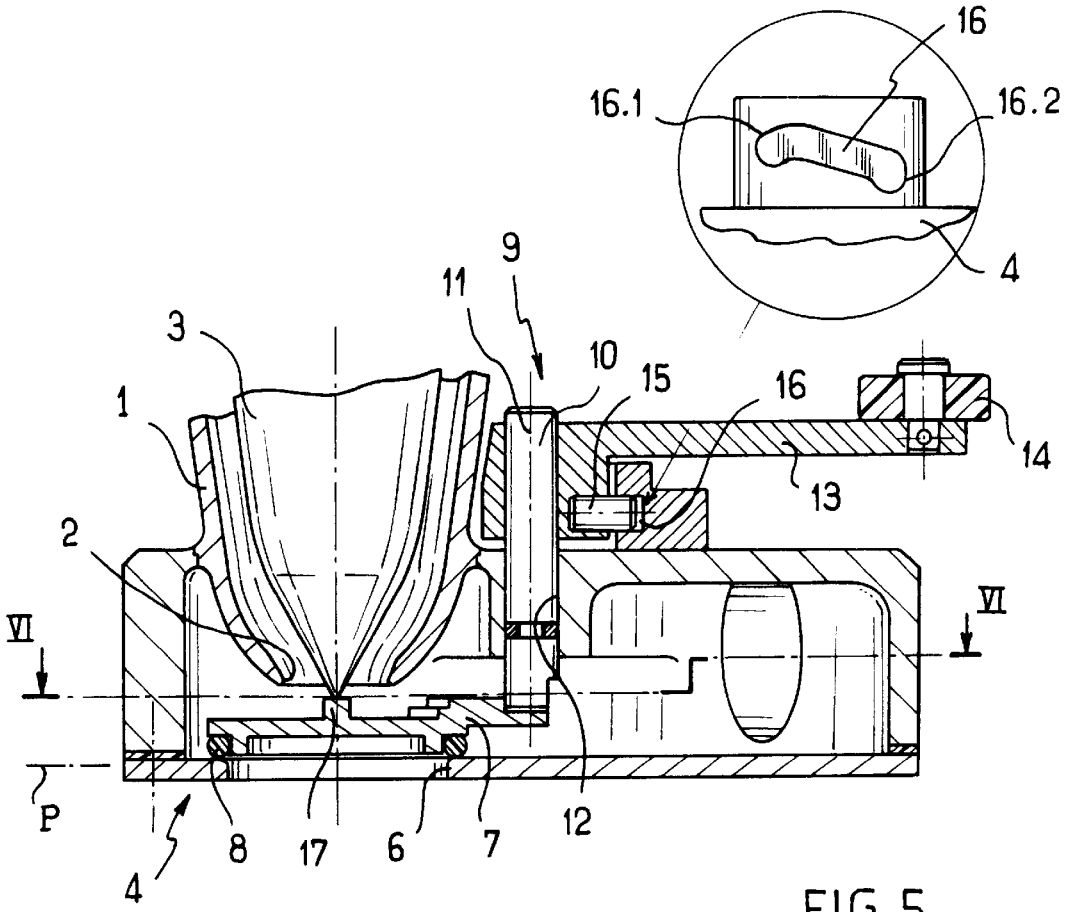
FIG. 5 is a section view on line V—V of FIG. 4.
Figure 6:
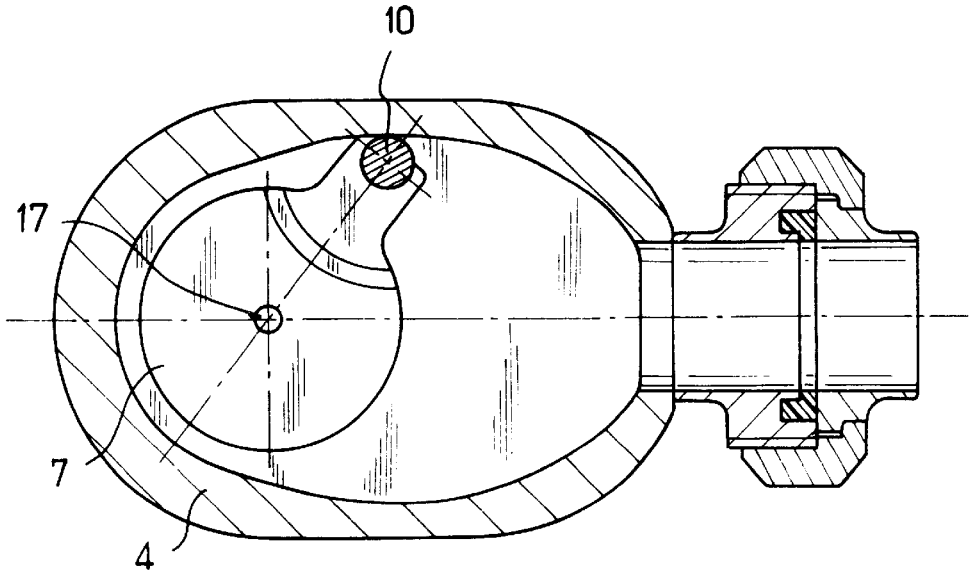
FIG. 6 is a section view on line VI—VI of FIG. 5.

With reference more particularly to FIG. 5, the actuator member 9 has a shaft 10 extending in a direction 11 normal to the plane P containing the through orifice 6. The shaft 10 is received in a bore 12 of the collector pan 4 so as to be capable of turning and sliding along the bore in leakproof manner. At one end, the shaft 10 extends into the collector pan 4 and has the shutter member 7 welded thereto in off-center manner relative to the direction 11, and at its opposite end the shaft 10 extends outside the collector pan 4 and is secured to one end of a control arm 13 whose other end is associated with a wheel 14.

The actuator member 9 also has a stud 15 extending transversely to project from the shaft 10 so as to be received in a groove 16 formed in the collector pan 4. The groove 16 extends helically about the shaft 10 and it has a top end portion 16.1 and a bottom end portion 16.2, both of which are curved downwards (see detail in FIG. 5). These end portions 16.1 and 16.2 receive the stud 15 respectively when the shutter member 7 is in its disengaged position, and when the shutter member is in its shut position.

In operation, receptacles are filled while the shutter member 7 is in its disengaged position as shown in FIGS. 1 to 3. The stud 15 is then received in the and portion 16.1 of the groove 16 and its curvature constitutes an abutment for holding the stud 17 in this position in a manner that is stable in spite of the vibration associated with the device operating.

When a cleaning stage is to be begun, the plug 3 is raised into a position for opening the flow orifice 2 and cam surfaces carried by the structure are actuated so as to extend into the path of the wheels 14 during rotation of the platform carrying the filling heads so as to act on the control arm 13 (see FIGS. 4 to 6). The shaft 10 then pivots and the stud 15 is moved from the end portion 16.1 of the groove 16 to the end portion 16.2. The top edge of the groove 16 forms a cam causing the rigid assembly constituted by the actuator member 9 and the shutter member 7 to move axially in combination with said assembly pivoting so as to provide helical motion that brings the shutter member 7 into its shut position.

Once the shutter member 7 is in the shut position, the plug 3 is moved back down until it bears against a top portion 17 of the shutter member 7 which is organized so as to hold the plug 3 in a position such that the flow orifice is at least partially open. The cleaning liquid under pressure then flows through the delivery duct 1, into the collector pan 4, and then into the collector manifold 5. The pressure of the cleaning substance and the weight of the plug 3 contribute to pressing the shutter member 7 more firmly against the collector pan 4, thereby compressing the O-ring 8. The curvature of the end portion 16.2 is determined in such a manner that the stud 15 does not come into abutment against the bottom edge of the groove 16 during this small axial displacement.

The end of cleaning is controlled by a cam surface carried by the structure returning the control arm 13 to its position that corresponds to the disengaged position of the shutter member 7.

Naturally, the invention is not limited to the embodiment described and variants can be applied thereto without going beyond the ambit of the invention as defined by the claims.

In particular, the shutter member 7 can be placed outside the collector pan 4, in which case its helical motion is reversed.

In addition, the means enabling the rigid assembly formed by the shutter member 7 and the actuator member 9 to move helically could comprise a helical slot receiving the arm 13, in which case it would be preferable for the arm to be of circular section.

What is claimed is:

1. A filling device comprising at least one delivery duct saving a flow orifice associated with a plug and fitted with a cleaning device comprising a collector pan fixed in leak-proof manner to the delivery duct in the vicinity of the flow orifice, the collector pan having a through orifice vertically in register with the flow orifice, and the cleaning device comprising a shutter member connected to an actuator member and movable between a position for shutting the through orifice and a position for disengaging said orifice, wherein the actuator member and the associated shutter member are fixed to each other to form a rigid assembly mounted to move with helical motion about an axis normal to a plane containing the through orifice, and wherein the shutter member is located off said axis.

2. A filling device according to claim 1, wherein the shutter member is disposed inside the collector pan.

3. A filling device according to claim 1, wherein the actuator member includes a stud projecting from the axis to be received in a helical groove formed in the collector pan.

4. A filling device according to claim 3, wherein the helical groove has a downwardly-curved end portion to receive the stud when the shutter member is in its disengaged position.

5. A filling device according to claim 3, wherein the helical groove includes a downwardly-curved end portion for receiving the stud when the shutter member is in its shut position.

6. A filling device according to claim 1, wherein the shutter member has a top portion organized to support the plug in a position where the flow orifice is at least partially open while the shutter member is in its position for shutting the through orifice.

* * * * *

UNITED STATES PATENT AND TRADEMARK OFFICE

CERTIFICATE OF CORRECTION

PATENT NO. : 6,267,157 B1
DATED : July 31, 2001
INVENTOR(S) : Bertrand Gruson et al.

It is certified that error appears in the above-identified patent and that said Letters Patent is hereby corrected as shown below:

Title page,
Item [73] Assignee, replace "Serac Griyo, La Ferte Bernard (FR)" with -- Serac Group, La Ferte Bernard (FR) --.

Signed and Sealed this

Fifteenth Day of January, 2002

*Attest:*

*Attesting Officer*

JAMES E. ROGAN
*Director of the United States Patent and Trademark Office*